US007694368B2

(12) United States Patent
Lewis, Jr.

(10) Patent No.: US 7,694,368 B2
(45) Date of Patent: Apr. 13, 2010

(54) POSITIVE LOCK FOR HEIGHT ADJUSTABLE AMBULANCE COT

(75) Inventor: Richard J. Lewis, Jr., Loveland, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 109 days.

(21) Appl. No.: 11/779,301

(22) Filed: Jul. 18, 2007

(65) Prior Publication Data

US 2008/0028527 A1 Feb. 7, 2008

Related U.S. Application Data

(60) Provisional application No. 60/821,469, filed on Aug. 4, 2006.

(51) Int. Cl.
*A47B 7/02* (2006.01)

(52) U.S. Cl. ..... 5/611; 5/11; 5/86.1; 296/20

(58) Field of Classification Search ..... 5/611, 5/86.1, 618, 83.1, 11; 296/20
See application file for complete search history.

(56) References Cited

U.S. PATENT DOCUMENTS 3,057,655 A 10/1962 Well et al.
3,212,463 A 10/1965 Anderson et al.
3,741,586 A 6/1973 Wiczer
5,432,966 A 7/1995 Berta
5,435,027 A 7/1995 Bourgraf et al.
5,502,854 A * 4/1996 Daouk ..... 5/627
5,537,700 A * 7/1996 Way et al. ..... 5/611
6,151,732 A * 11/2000 Heimbrock et al. ..... 5/601
6,240,582 B1 * 6/2001 Reinke ..... 5/601
6,276,010 B1 8/2001 Way et al.
6,320,510 B2 * 11/2001 Menkedick et al. ..... 340/573.1
6,389,623 B1 5/2002 Flynn et al.
6,526,611 B2 3/2003 Flynn et al.
2006/0031989 A1 * 2/2006 Graham et al. ..... 5/610
2007/0234475 A1 * 10/2007 Sharps ..... 5/81.1 R
2008/0271242 A1 * 11/2008 Hjort ..... 5/85.1

* cited by examiner

*Primary Examiner*—Peter M Cuomo
*Assistant Examiner*—Brittany M Wilson
(74) *Attorney, Agent, or Firm*—Dinsmore & Shohl LLP

(57) ABSTRACT

A positive lock for an ambulance cot and method thereof which requires lifting an upper frame of the ambulance cot, in order to permit a spring actuator to clear an interference fit of the positive lock, are provided. If the upper frame is not lifted, then the spring force used to pull on the positive lock is insufficient to overcome the interference fit. Clearing the interference fit permits the cot to be height adjusted. Optionally, a light indicator may be provided which illuminates if the cot has not been positively locked in a height adjusted position.

20 Claims, 4 Drawing Sheets

POSITIVE LOCK FOR HEIGHT ADJUSTABLE AMBULANCE COT

CROSS REFERENCE TO RELATED APPLICATIONS

This application claims the benefit of the following U.S. Provisional Application: Ser. No. 60/821,469 for POSITIVE LOCK FOR HEIGHT ADJUSTABLE AMBULANCE COT, filed Aug. 4, 2006.

FIELD OF THE INVENTION

This invention relates to ambulance cots, and more particularly to a positive lock for a height adjustable ambulance cot which requires lifting an upper frame of the ambulance cot, in order to permit the cot to height adjust.

BACKGROUND OF THE INVENTION

One of the leading causes of potential patient handling accidents is having an ambulance cot drop unexpectedly from an elevated position to its lowered position with a patient onboard. In such cases, injuries can occur not only to the patient but also to the Emergency Medical Service (EMS) personnel.

The typical reason for such droppings is operator error, e.g., not ensuring that the cot is fully locked in the full-upright position, or inadvertent operation of one of the release handles. Such operator errors, although unacceptable, are understandable considering EMS personnel are operating in a busy and potential hazardous environment. Accordingly, under such pressure to perform efficiently in such an intense environment, routine tasks such as operating an ambulance cot with a patient thereon presents the potential for making such mistakes.

SUMMARY OF THE INVENTION

It is against the above-mentioned background that a positive lock for a height adjustable ambulance cot and method thereof which requires lifting an upper frame of the ambulance cot, in order to permit a spring actuator to clear an interference fit of the positive lock, are provided. If the upper frame is not lifted, then the spring force used to pull on the positive lock is insufficient to overcome the interference fit. Clearing the interference fit permits the cot to be height adjusted. Optionally, a light indicator may be provided which illuminates if the cot has not been positively locked in a height adjusted position, e.g., a full upright position.

In one embodiment, provided is a height adjustable ambulance cot comprising an upper frame providing at least one channeled support member having a plurality of holes; a support mechanism configured to height adjust the upper frame; a traverse frame member pivotably connected to the support mechanism; at least one latching trolley configured for movement about the at least one channeled support member, the at least one latching trolley being connected to the traverse frame member; and a positive lock having at least one locking pin configured to be held releaseably in the plurality of holes via an interference fit, wherein the interference fit is cleared by lifting the upper frame, thereby permitting the at least one locking pin to be releasably from an engaged one of the plurality of holes.

In another embodiment, provided is a method of adjusting height of an emergency cot according to the present invention. The method comprises lifting an upper frame of the cot to clear an at least one locking pin of an interference fit; operating an actuator provided to the cot to release the at least one locking pin from an engaged one of a plurality of holes; and repositioning a traverse frame member of the cot about an at least one channeled support to height adjust the cot.

In still another embodiment, provided is a height adjustable ambulance cot comprising an upper frame providing at least one channeled support member having a plurality of holes; a lower frame providing castor wheels; a support mechanism connected between the upper and lower frames and configured to height adjust the upper frame relative to the lower frame; a traverse frame member pivotably connected to the support mechanism; at least one latching trolley configured for movement about the at least one channeled support member, the at least one latching trolley being connected to the traverse frame member; and a positive lock having at least one locking pin configured to be held releaseably in the plurality of holes via an interference fit, a pivoting arm mounted pivotably to the traverse frame member and connected to an actuator via a spring, the spring having a spring constant that is insufficient to overcome the interference fit, wherein the pivoting arm is configured to move the at least one locking pin from an engaged one of the plurality of holes via operation of the actuator upon clearing the interference fit, wherein the interference fit is cleared by lifting the upper frame. Optionally, a light indicator configured to illuminate when the at least one locking pin is disengaged from the plurality of holes may be provided.

These and other features of the present invention will become clear from the following detailed description, the accompanying drawings, and the appended claims.

BRIEF DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DETAILED DESCRIPTION

Figure 1:
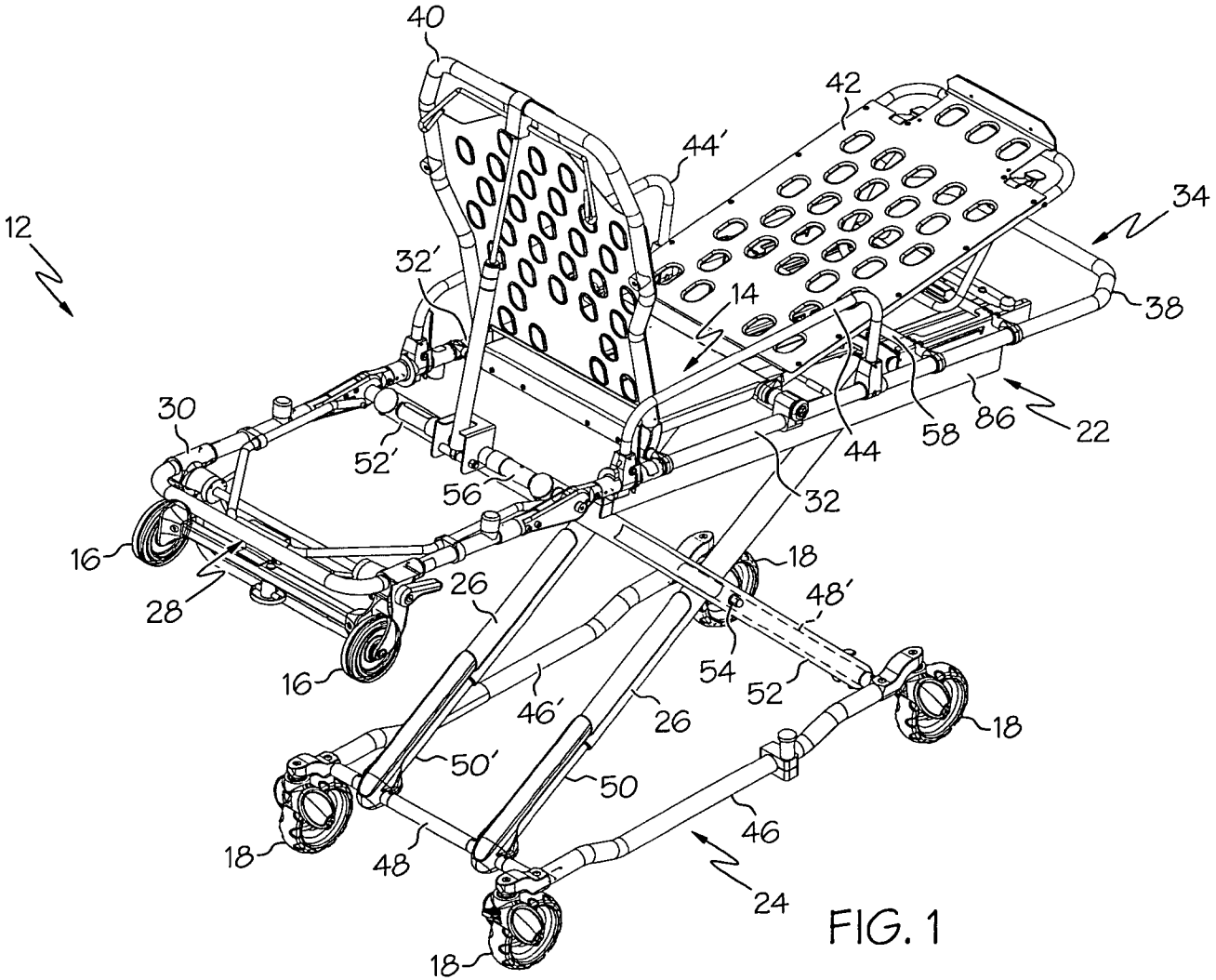
FIG. 1 is an elevated perspective view of a cot structure embodiment of the invention.

FIG. 1 shows a height adjustable cot according to one embodiment of the present invention, which is generally indicated by symbol 12. A patient may be supported upon a support surface, which is generally indicated by symbol 14, and conveniently loaded onto an elevated surface, such as for example, the transport bay of an ambulance, using loading wheels 16. The cot 12 is moved either along a surface in the fully elevated position as illustrated, using swivel wheels 18, or in a fully lowered position upon wheels 16 and 18.

The cot 12 comprises generally an upper frame 22, a lower frame 24, and a support mechanism 26 disposed therebetween for supporting and moving the upper frame 22 relative to the lower frame 24. The upper frame 22 is generally rectangular, and at a loading end 28 comprises a leading end frame member 30 coupled rotatably to a pair of opposed, longitudinally extending side frame members 32 and 32'. At a trailing end 34, the side frame members 32 and 32' are coupled to a trailing end frame member 36, having a bent U-shape handle bar frame member 38. The frame members 30, 32, 32', 36, and 38 are a tubular material, such as metal, laminate, plastics, or combinations thereof.

In the illustrated embodiment, the leading end frame member 30 is coupled rotatably to the opposed side frame members 32 and 32', and is a drop frame, such as the type disclosed by U.S. Pat. No. 6,701,545, a patent commonly assigned to Ferno Washington, Inc., and the disclosure of which is herein fully incorporated by reference. The loading wheels 16 are provided to the leading end frame member 30.

The upper frame 22 includes the patient support 14. The patient support 14 includes back and leg rests 40 and 42, respectively, which may be positioned in a number of raised positions. The upper frame 22 further includes a pair of side-arm supports 44 and 44', which are each rotatably mounted to respective side frame members 32 and 32'.

In another embodiment, the upper frame 22 is a support platform for releasably receiving a multipurpose roll-in cot (not shown). In such an embodiment, mounting engagements would be provided instead of the patent support 14 to support a multipurpose roll-in cot such as, for example, the types disclosed by U.S. Pat. No. 4,037,871, and PCT Application No. US01/45144 (WO0239944), references commonly assigned to Ferno Washington, Inc., the disclosures of which are herein fully incorporated by reference.

The lower frame 24 is generally rectangular, and provides one of the swivel wheels 18 at each corner thereof. The wheels 18 may be conventional caster wheels with foot-operated locking mechanisms. The lower frame 24 comprises a pair of longitudinally extending side frame members 46 and 46' separated by lower transverse frame members 48 and 48' provided at the loading end 28 and the trailing end 34, respectively.

In the illustrated embodiment, the support mechanism 26 is an x-frame, but in other embodiments may be any other type of height adjustable support mechanism for an ambulance cot. As shown, the x-frame includes a first pair of parallel legs 50 and 50', and a second pair of parallel legs 52 and 52'. Respective ones of the pairs of parallel legs 50 and 52 and 50' and 52' are pivotably connected together at an intermediate location by a respective pivot connection 54 (which is the same on side not shown). The lower ends of the first pair of legs 50, 50' are pivotably connected to the lower leading transverse frame member 48. The lower ends of the second pair of legs 52 and 52' are pivotably connected to the lower trailing transverse frame member 48' of the lower frame 24. The upper ends of the second pair of legs 52, 52' are pivotably connected to upper frame 22 via an upper traverse frame member 56. The upper ends of the first pair of legs 50 and 50' are pivotably connected to the upper frame 22 via a releasable traverse frame member 58, which is best shown in FIG. 2 and the means to release the traverse frame member 58 is discussed in greater detail in a later section.

Figure 2:
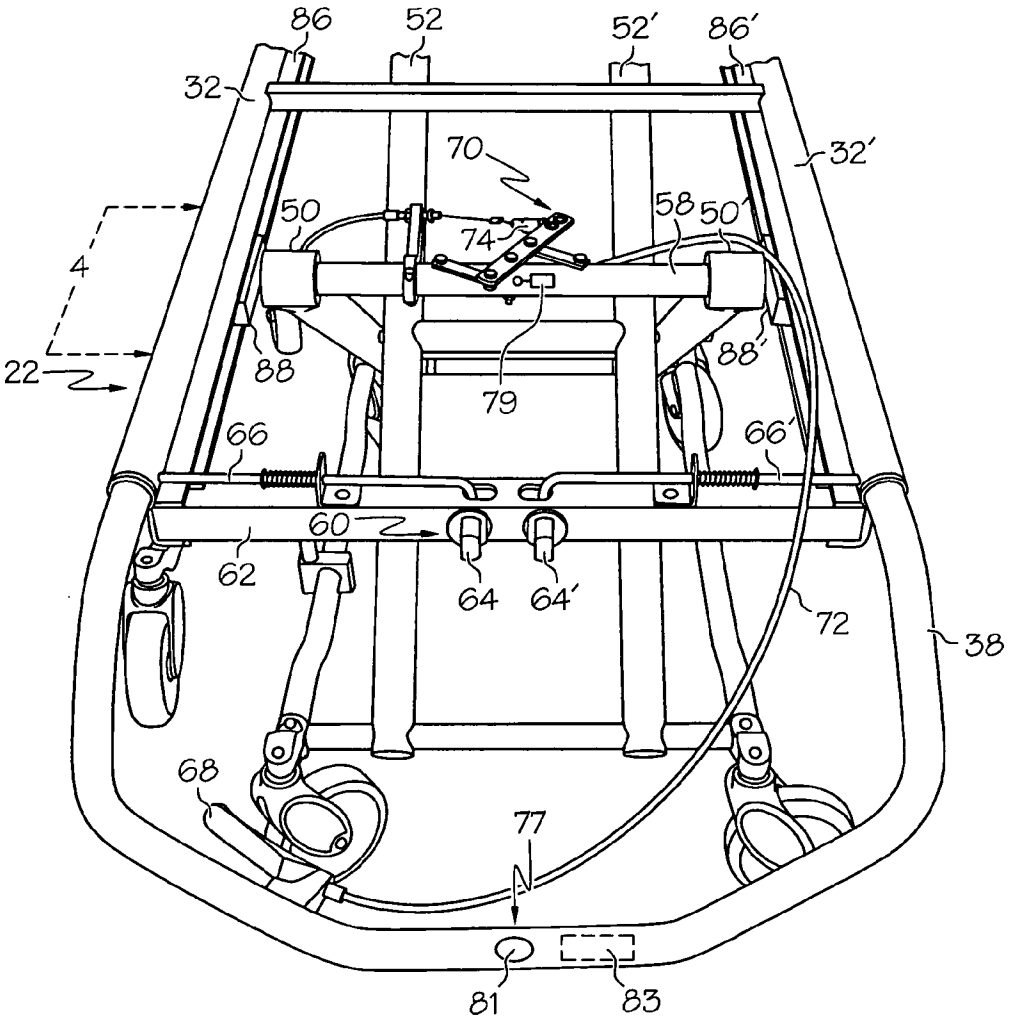
FIG. 2 is a top plan view of the embodiment of FIG. 1, with parts broken away to show underlying parts including the positive lock according to the present invention.

With reference to FIG. 2, a handle bar locking device 60 is provided to a trailing end cross member 62. The handle bar locking device 60 includes a pair of actuators 64 and 64' each functionally connected to a respective one of a pair of pinning rods 66 and 66'. The pinning rods 66 and 66' are spring biased, and each of the pining rods is normally accommodated within a respective recess or hole provided in the frame member 38 each through a respective hole provided in side frame members 32 and 32'. Operating the actuators 64 and 64' in unison, such as for example, squeezing the actuators 64 and 64' together, clears the pair of pinning rods 66 and 66' from their engagement with frame member 38. Clearing the engagement of the pinning rods 66 and 66' thereby permits an operator to adjust slidably (extend or retract) the frame member 38 to a desired horizontal position relative to side frame members 32 and 32'.

A hand operated actuator 68 is also provide to the frame member 38, and is operatively connected to a positive lock 70 according to the present invention. In particular, a pull cable 72 of the hand operated actuator 68 is connected to a spring 74 of the positive lock 70, and positioned via a brace or stanchion 75. Optionally, a light indicator, generally indicated by symbol 77, may be provided to the cot 12 which illuminates if the cot has not been positively locked in a height adjusted position, such as for example, the full upright position illustrated by FIG. 2. The light indicator 77 in one embodiment includes a contact switch 79, a light 81, such as an LED, and a battery 83. Other illumination methods and circuit arrangements for providing an indication that the cot 12 is not properly locked in a height adjusted position may also be used with the present invention.

Figure 3:
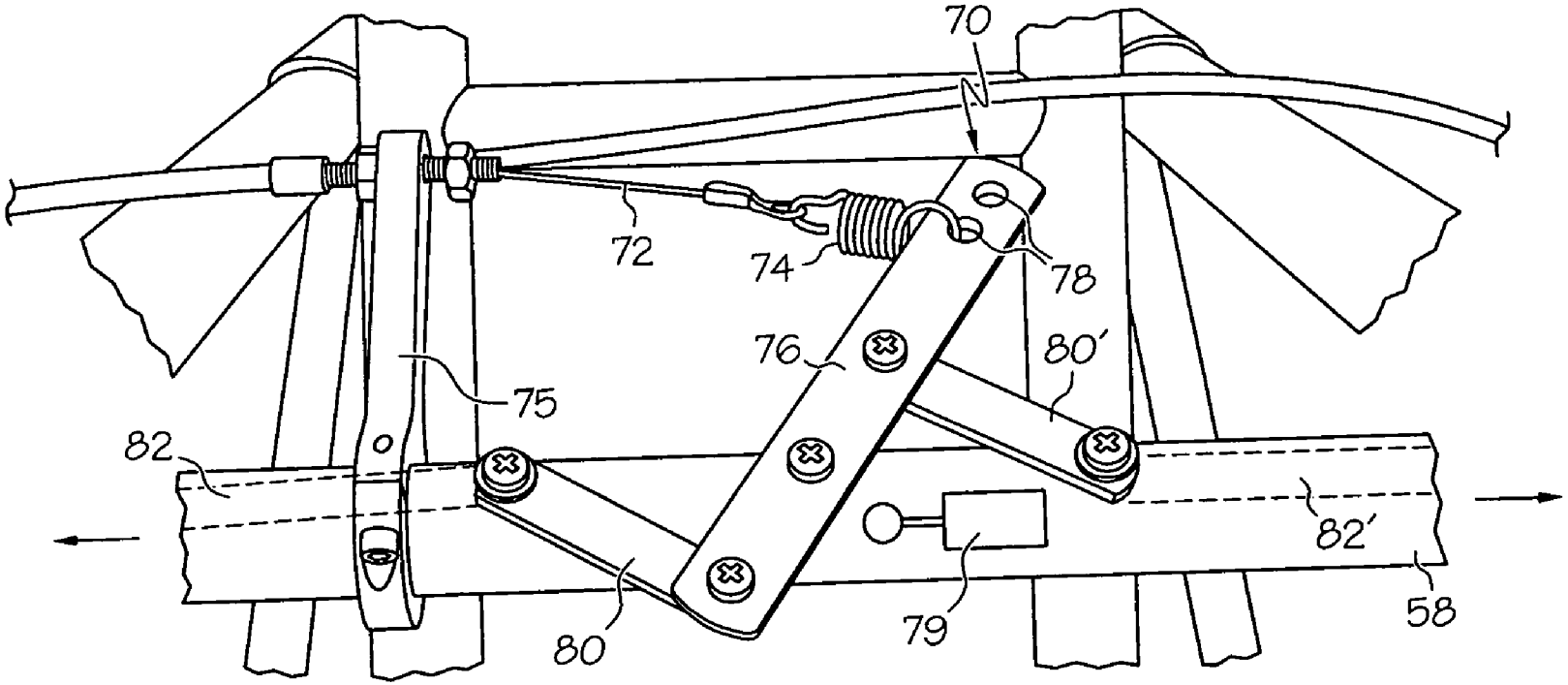
FIG. 3 is an enlarged fragmented perspective view of a portion of the embodiment of FIG. 2, with parts removed to show underlying parts including the positive lock according to the present invention.

As best shown by FIG. 3, the spring 74 is connected to a pivoting arm 76. The mechanical advantage (moment) provided by the spring 74 is made adjustable by the spring constant of the spring used and the positioning of the spring 74 along the length of the pivoting arm 76, such as for example, via holes 78. As shown, the pivoting arm 76 is mounted pivotably to the releasable traverse frame member 58. A pair of pull members 80 and 80' are also connect pivotably to the pivoting arm 76 and are each connected to a respective one of a pair of locking pins 82 and 82'. The locking pins 82 and 82' are accommodated slidably within the releasable traverse frame member 58, and each are spring biased in the direction of their respective arrow shown in FIG. 3.

It is to be appreciated that should the pivoting arm 76 not return to a non-operated position, such as illustrated by FIG. 3, contact between the contact switch 79 and pivoting arm will remain, thereby energizing and illuminating the light 81 to indicate that the cot 12 has not been positively locked in a height adjusted position. When the pair of locking pins 82 or 82' are properly engaged, locking the cot in a height adjusted position, such as for example the full upright position illustrate by FIG. 2, there is no contact between the contact switch 79 and the pivoting arm 76, which de-energizes the light 81, which indicates that the cot is properly locked in a height adjusted position. It is to be appreciated that the location about the cot, the number, and the type of switch and/or light used to indicate that the cot 12 has or has not properly locked in a height adjusted position may vary in other embodiments, and as such light indication methods and circuits are believed to be well within the scope of one skilled in the art, no further discussion is provided.

Figure 4:
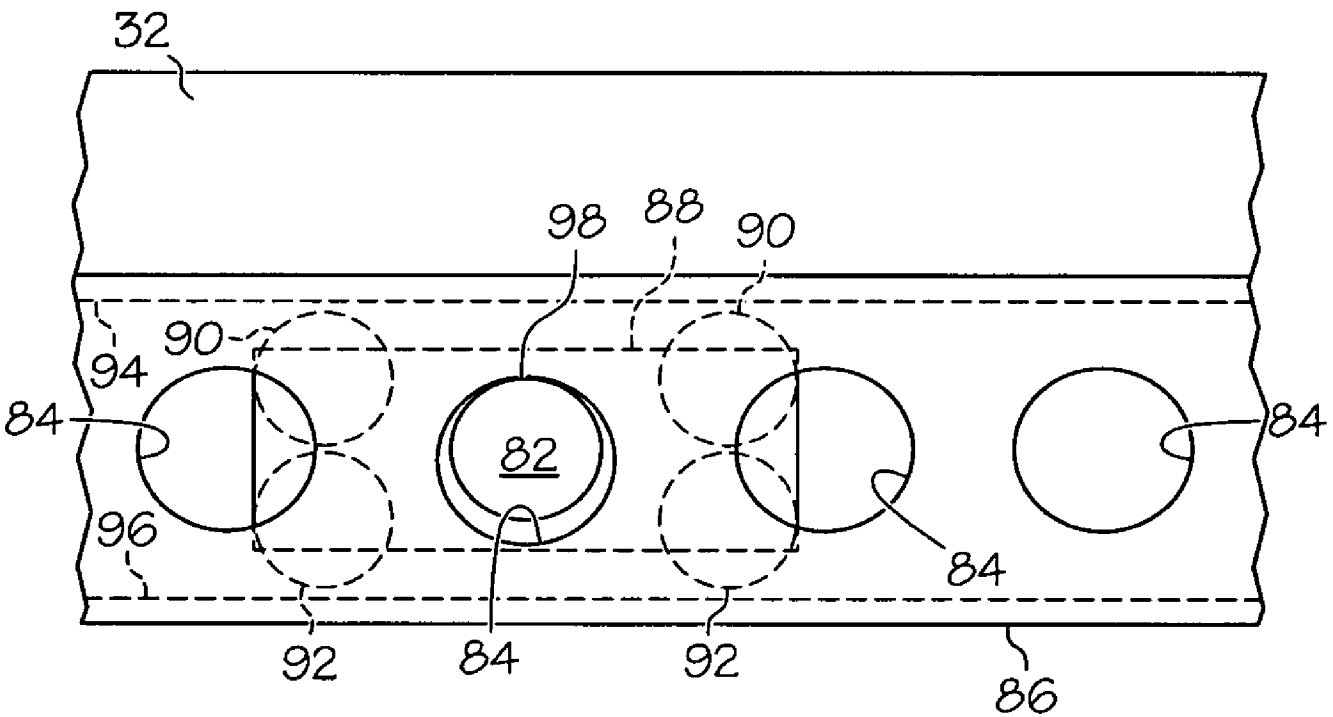
FIG. 4 is a side section view of the embodiment of FIG. 2 taken only section line 4-4, and shows underlying parts including parts of the positive lock according to the present invention.

With reference made also to FIGS. 2 and 4, with FIG. 4 showing only one side of the cot as the other side is the same, it is to be appreciated that in the illustrated spring bias direction of FIG. 3, the locking pins 82 are 82' are seated in one of a plurality of holes 84 provided along respective channeled support members 86 and 86'. In one embodiment, the channeled support members 86 and 86' are c-shaped. The channeled support members 86 and 86', as best shown by FIG. 2, extend adjacently along their respective side frame member 32 and 32', and are c-shaped to provide a rolling track to a respective one of a pair of latching trolleys 88 and 88'. The latching trolleys 88 and 88' are provided at respective ends of the releasable traverse frame member 58 such that the frame member 58 is slidably accommodated along the channeled support members 86 and 86'. Accordingly, the latching trolleys 88 and 88', along with frame member 58, are releasably secured via the engagement of the locking pins 82 are 82' within one of a plurality of holes 84 provided along the respective channeled support members 86 and 86'.

As best shown by FIG. 4, each of the latching trolleys 88 and 88' are provided with upper and lower rollers 90 and 92. In a weighted position, the upper rollers 90 engage with an upper track portion 94 of each respective channeled support member 86 and 86', and in an unweighted position, the lower rollers 92 engage a lower track portion 96 thereof. It is to be appreciated that in the weighted position, the mechanical advantage provided by operating the actuator 68 (FIG. 2), which pulls on spring 74, is insufficient to unseat the locking pins 82 and 82' from their interference fit 98 with their respective hole 84. In other words, the spring constant is such that the pivoting arm 76 does not move due to the interference fit 98, thereby causing the spring 74 to stretch from the pull of the pull cable 72 when pulled via operation of the actuator 68. Therefore in the weighted position, the positive lock 70 does not permit the cot 12 to be height adjusted even if the actuator is operated.

To height adjust the cot 12, EMS personnel positioned at the loading and trailing ends 28 and 34, need to lift the upper frame 22 of the cot 12 slightly while also operating the actuator 68. Lifting the cot 12 in this manner, better ensures that the EMS personnel have positive control of the cot while intending to height adjust the cot. With the upper frame 22 slightly lifted in the unweighted position, it is to be appreciated that the lower rollers 92 will engage the lower track portion 96, which clears the locking pins 82 and 82' of their interference fit 98. Accordingly, in the unweighted position, the locking pins 82 and 82' will unseat from the respective hole 84 due to the pivoting of the pivoting arm 76 from the pull of the pull cable 72 and spring 74.

It is to be appreciated that operation of the actuator 68 pulls on the pull cable 72 and spring 74, and with the interference fit 98 cleared, now has enough mechanical advantage to overcome the spring bias of the locking pins 82 and 82' in the direction opposite of the arrows shown in FIG. 3, thereby releasing the latching trolleys 88 and 88' and frame member 58 for sliding movement about channeled support members 86 and 96'. Releasing the releasable traverse frame member 58, when released by actuation of the actuator 68 with the positive lock 70 in the unweighted position, permits the upper ends of the first pair of legs 50 and 50' to pivot and transition longitudinally such that the upper frame 22 may be positioned vertically relative to the lower frame 24 in the fully lowered, fully extended, or a plurality of positions therebetween as provided by the plurality of holes 84 along the channeled support members 86 and 86'.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A height adjustable ambulance cot comprising:

an upper frame providing at least one channeled support member having a plurality of holes, said at least one channeled support member having inner surfaces which comprise an upper track portion and a lower track portion;

a support mechanism configured to height adjust said upper frame;

a traverse frame member pivotably connected to the support mechanism;

at least one latching trolley configured for movement about said at least one channeled support member, said at least one latching trolley being connected to said traverse frame member, said at least one latching trolley comprising upper and lower rollers, wherein in a weighted position, said upper rollers engage said upper track portion, and in an unweighted position, said lower rollers engage a lower track portion of said at least one channeled support member; and a positive lock having at least one locking pin configured to be held releaseably in said plurality of holes via an interference fit in said weighted position, wherein said interference fit is cleared by lifting said upper frame to said unweighted position, thereby permitting said at least one locking pin to be released from an engaged one of said plurality of holes.

2. The height adjustable ambulance cot according to claim 1, wherein said at least one locking pin is released from the engaged one of said plurality of holes via an actuator upon clearing said interference fit by lifting said upper frame.

3. The height adjustable ambulance cot according to claim 1, wherein said positive lock further includes a pivoting arm mounted pivotably to said traverse frame member, said pivoting arm is configured to move said at least one locking pin via operation of an actuator upon clearing said interference fit by lifting said upper frame.

4. The height adjustable ambulance cot according to claim 1, wherein said positive lock further includes a pivoting arm mounted pivotably to said traverse frame member and connected to an actuator via a spring, said spring having a spring constant that is insufficient to overcome said interference fit, and wherein said pivoting arm is configured to move said at least one locking pin via operation of said actuator upon clearing said interference fit by lifting said upper frame.

5. The height adjustable ambulance cot according to claim 1, further comprising an extendable handle bar frame member, wherein said at least one locking pin is released from the engaged one of said plurality of holes via an actuator, mounted on said extendable handle bar frame member, upon clearing said interference fit by lifting said upper frame.

6. The height adjustable ambulance cot according to claim 1, further comprising an extendable bent U-shape handle bar frame member, wherein said at least one locking pin is released from the engaged one of said plurality of holes via an actuator, mounted on said extendable handle bar frame member, upon clearing said interference fit by lifting said upper frame.

7. The height adjustable ambulance cot according to claim 1, further comprising an extendable handle bar frame member, wherein said at least one locking pin is released from the engaged one of said plurality of holes via an actuator, mounted on said extendable handle bar frame member, upon clearing said interference fit by lifting said upper frame, and wherein said cot further comprises a handle bar locking device having a pair of actuators each connected to a respective one of a pair of spring biased pinning rods normally accommodated within a respective hole provided through said upper frame and at least partially into said handle bar frame member.

8. The height adjustable ambulance cot according to claim 1, wherein said at least one locking pin is spring biased and accommodated slidably within said traverse frame member.

9. The height adjustable ambulance cot according to claim 1, further comprising a hand operated actuator operatively connected to said positive lock via a pull cable connected to a spring of said positive lock, said positive lock further includes a pivoting arm mounted pivotably to said traverse frame member and connected to said spring, and an at least one pull member connected pivotably to said pivoting arm and said at least one locking pin.

10. The height adjustable ambulance cot according to claim 1, wherein the inner surfaces of said at least one channeled support member define a c-shape.

11. A method of adjusting height of an emergency cot according to claim 1, said method comprising:

lifting said upper frame to clear said at least one locking pin of said interference fit;

operating an actuator provided to said cot to release said at least one locking pin from an engaged one of said plurality of holes; and repositioning said traverse frame member about said at least one channeled support to height adjust said cot.

12. The method according to claim 11 wherein operating said actuator releases said at least one locking pin from the engaged one of said plurality of holes via pivoting of a pivoting arm from a pull of a pull cable and spring connected between said actuator and said pivoting arm, said pivoting arm being operatively connected to said at least one locking pin.

13. A height adjustable ambulance cot comprising:

an upper frame providing at least one channeled support member having a plurality of holes, said at least one channeled support member having inner surfaces which comprise an upper track portion and a lower track portion;

a lower frame providing castor wheels;

a support mechanism connected between said upper and lower frames and configured to height adjust said upper frame relative to said lower frame;

a traverse frame member pivotably connected to said support mechanism;

at least one latching trolley configured for movement about said at least one channeled support member, said at least one latching trolley being connected to said traverse frame member, said at least one latching trolley comprising upper and lower rollers, wherein in a weighted position, said upper rollers engage said upper track portion, and in an unweighted position, said lower rollers engage a lower track portion of said at least one channeled support member; and a positive lock having at least one locking pin configured to be held releaseably in said plurality of holes via an interference fit in said weighted position, a pivoting arm mounted pivotably to said traverse frame member and connected to an actuator via a spring, said spring having a spring constant that is insufficient to overcome said interference fit, wherein said pivoting arm is configured to move said at least one locking pin from an engaged one of said plurality of holes via operation of said actuator upon clearing said interference fit, wherein said interference fit is cleared by lifting said upper frame to said unweighted position.

14. The height adjustable ambulance cot according to claim 13, further comprising an extendable handle bar frame member, wherein said at least one locking pin is released from the engaged one of said plurality of holes via said actuator, mounted on said extendable handle bar frame member, upon clearing said interference fit by lifting said upper frame.

15. The height adjustable ambulance cot according to claim 13, further comprising an extendable bent U-shape handle bar frame member, wherein said at least one locking pin is released from the engaged one of said plurality of holes via said actuator, mounted on said extendable handle bar frame member, upon clearing said interference fit by lifting said upper frame.

16. The height adjustable ambulance cot according to claim 13, further comprising an extendable handle bar frame member, wherein said at least one locking pin is released from the engaged one of said plurality of holes said an actuator, mounted on said extendable handle bar frame member, upon clearing said interference fit by lifting said upper frame, and wherein said cot further comprises a handle bar locking device having a pair of actuators each connected to a respective one of a pair of spring biased pinning rods normally accommodated within a respective hole provided through said upper frame and at least partially into said handle bar frame member.

17. The height adjustable ambulance cot according to claim 13, wherein said at least one locking pin is spring biased and accommodated slidably within said traverse frame member.

18. The height adjustable ambulance cot according to claim 13, wherein said actuator is a hand operated actuator operatively connected to said positive lock via a pull cable connected to said spring of said positive lock, said positive lock further includes a pivoting arm mounted pivotably to said traverse frame member and connected to said spring, and an at least one pull member connected pivotably to said pivoting arm and said at least one locking pin.

19. The height adjustable ambulance cot according to claim 13, wherein the inner surfaces of said at least one channeled support member define a c-shape.

20. The height adjustable ambulance cot according to claim 13, comprising a light indicator configured to illuminate when said at least one locking pin is disengaged from said plurality of holes.

* * * * *